US009402471B1

(12) United States Patent
Gonzalez Ruiz

(10) Patent No.: US 9,402,471 B1
(45) Date of Patent: Aug. 2, 2016

(54) SPACE EFFICIENT BOOT HANGER

(71) Applicant: Rebeca Aimee Gonzalez Ruiz, Burnsville, MN (US)

(72) Inventor: Rebeca Aimee Gonzalez Ruiz, Burnsville, MN (US)

( * ) Notice: Subject to any disclaimer, the term of this patent is extended or adjusted under 35 U.S.C. 154(b) by 0 days.

(21) Appl. No.: 14/846,751

(22) Filed: Sep. 5, 2015

Related U.S. Application Data

(63) Continuation-in-part of application No. 14/594,140, filed on Jan. 11, 2015, now Pat. No. 9,125,487.

(51) Int. Cl.

| | |
|---|---|
| ***A47F 7/08*** | (2006.01) |
| ***A47B 61/04*** | (2006.01) |
| ***A47B 61/00*** | (2006.01) |
| ***A47G 25/00*** | (2006.01) |
| ***A47F 5/02*** | (2006.01) |
| ***A47F 5/04*** | (2006.01) |
| *A47F 5/08* | (2006.01) |

(52) U.S. Cl.
CPC ..... *A47B 61/04* (2013.01); *A47B 61/003* (2013.01); *A47F 5/02* (2013.01); *A47F 5/04* (2013.01); *A47F 7/08* (2013.01); *A47G 25/005* (2013.01); *A47F 5/0892* (2013.01)

(58) Field of Classification Search
CPC ..... A47F 61/04; A47F 61/003; A47F 7/08; A47F 7/10; A47F 7/06; A47F 7/12; A47F 5/0892; A47F 5/02; A47F 5/04; A47G 25/00; A47G 25/05
See application file for complete search history.

(56) References Cited

U.S. PATENT DOCUMENTS

| | | | | | |
|---|---|---|---|---|---|
| 1,747,951 | A * | 2/1930 | Reichert | ..... | A47F 7/06 211/30 |
| 2,125,045 | A * | 7/1938 | Connelly | ..... | A47F 7/08 211/163 |
| 2,529,565 | A * | 11/1950 | Mills | ..... | A43D 3/1416 12/114.6 |
| 2,690,571 | A * | 10/1954 | Gamble | ..... | A47C 21/00 211/34 |

(Continued)

*Primary Examiner* — Brian Glessner
*Assistant Examiner* — Paola Agudelo
(74) *Attorney, Agent, or Firm* — Mark A. Litman

(57) ABSTRACT

A transportable boot storage hanger designed for space-efficient and low-wear storage of multiple boots may have:

a) a topmost support engaging element;

b) a first vertical support rod having a top end engaged with the topmost support element and a lower portion of the first vertical support rod engaged with a hanger connecting element;

c) the hanger engaging element having an opening into which a multiple boot hanging frame is removably inserted or permanently attached;

d) the multiple boot hanging frame having at least two major outward arms extending away from the opening;

e) each of the at least two major arms having a vertical arm and a sole support element angle upwardly away from the first vertical support rod; and f) the sole support element having a top toe support stem and a lower heel support stem.

20 Claims, 3 Drawing Sheets

(56) References Cited

U.S. PATENT DOCUMENTS 2,941,669 A * 6/1960 Palay ..... A47B 96/1425 211/1.55
3,135,389 A * 6/1964 Farley ..... A47F 7/08 211/115
3,734,301 A * 5/1973 Rastocny ..... A47F 5/05 211/165
3,802,572 A 4/1974 Shackel
3,979,786 A * 9/1976 Vierra ..... A43D 3/1491 12/128 B
4,460,094 A 7/1984 Schoen
4,669,615 A 6/1987 Zigman
4,823,962 A 4/1989 Arias
4,953,715 A 9/1990 Celli
5,065,871 A 11/1991 Chan
5,423,435 A * 6/1995 Pollard ..... A47F 7/08 211/163
5,785,185 A * 7/1998 Klebba ..... A47F 7/08 211/163
6,119,871 A 9/2000 Mengel
7,467,481 B2 * 12/2008 Christian ..... A47L 23/205 34/104

* cited by examiner

SPACE EFFICIENT BOOT HANGER

RELATED APPLICATIONS DATA

This application claims priority under 35 U.S.C. 120 from co-pending U.S. patent application Ser. No. 14/594,140, filed Jan. 11, 2015, now U.S. Pat. No. 9,125,487, issued 8 Sep. 2015.

BACKGROUND OF THE INVENTION

1. Field of the Invention

The present invention relates to the field of foot ware storage devices and especially boot storage devices for relatively large numbers of boots, and the boot storage devices are sufficient space efficient that they may be hung on supports and in closets.

2. Background of the Art

Foot ware are essential items in a modern society, providing both function in protecting the feet of the user and providing essential style to the dress appearance of the user. Boots tend to be either more functional (as industrial or work strength protective foot ware, as equestrian riding apparel, as climbing apparel, as hiking apparel and the like) or even a stronger fashion statement for decorative purposes.

The majority of existing boot supports have the boots supported by grasping exterior portions of the boots, such as the boot straps, the boot heels and/or the exterior soles of the shoes. Examples of these structures are U.S. Pat. No. 4,953,715 (Celli); U.S. Pat. No. 4,669,615 (Zigman); and U.S. Pat. No. 3,802,572 (Shackel). Other systems provide essentially linear and upward facing supports that may poke into the material of the boot or support the boot against an interior surface with a single forward point of contact against the toe of the boot. Examples of these systems are U.S. Pat. No. 4,460,094 (Schoen); U.S. Pat. No. 4,832,962 (Arias); U.S. Pat. No. 5,065,871 (Chan); U.S. Pat. No. 6,119,871 (Mengel); and U.S. Pat. No. 7,467,481 (Christian). These documents are incorporated by reference in their entirety.

Improvements in space-conserving boot storage is still desirable, and is offered in the practice of the present novel technology enabled herein.

SUMMARY OF THE INVENTION

A transportable boot storage hanger designed for space-efficient and low-wear storage of multiple boots may have:

a) a topmost support engaging element;
b) a first vertical support rod having a top end engaged with the topmost support element and a lower portion of the first vertical support rod engaged with a hanger connecting element;
c) the hanger engaging element having an opening into which a multiple boot hanging frame is removably inserted or permanently attached;
d) the multiple boot hanging frame having at least two major outward arms extending away from the opening;
e) each of the at least two major arms having a vertical arm and a sole support element angle upwardly away from the first vertical support rod; and
f) the sole support element having a top toe support stem and a lower heel support stem.

BRIEF DESCRIPTION OF THE FIGS

DETAILED DESCRIPTION OF THE INVENTION

Figure 1:
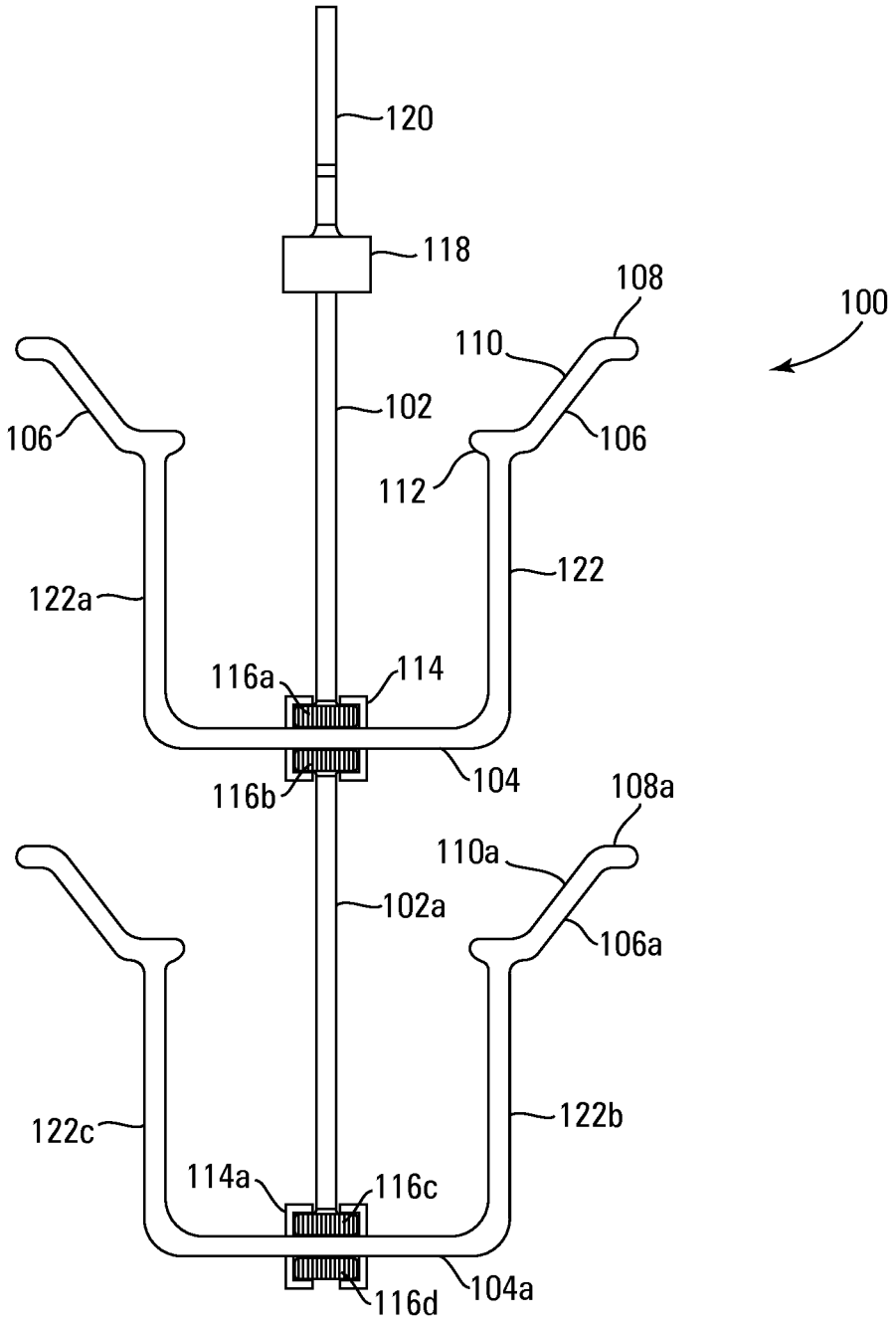
FIG. 1 is a front view of a boot hanger system according to the present technology.

The present technology relates to a transportable boot storage hanger designed for space-efficient and low-wear storage of multiple boots. By transportable is meant that the hanger may be carried from closet to support rod and hung without disassembly, and with or without boots being supported on the hanger. The hanger may be supported on any support surface, even beyond closets and rods, such as door frames, ceiling hooks and the like, merely by appropriate configuration of the hooking element at the top of the hanger. The hanger or hanger system may have components generally described as:

a) a topmost support engaging element;
b) a first vertical support rod having a top end engaged with the topmost support element and a lower portion of the first vertical support rod engaged with a hanger connecting element;
c) the hanger engaging element having an opening into which a multiple boot hanging frame is removably inserted or permanently attached (it may be permanently attached by being part of an initially molded structure, adhesively secured therein, or fused to the other portions of the structure);
d) the multiple boot hanging frame having at least two major outward arms extending away from the opening;
e) each of the at least two major arms (e.g., 3 or 4 and even 6 are useful) having a vertical arm and a sole support element angle upwardly away from the first vertical support rod; and
f) the sole support element having a top toe support stem and a lower heel support stem.

The structural components and elements (hooks, rods, stems, arms, supports and the like) should be made of materials with both rigidity (so that weight of boots will not cause elements to break or inelastically deform) and resistance to elongation, yet be relatively lightweight. Structural materials such as metals (including steel, stainless steel, aluminum, brass, bronze and the like), polymeric materials (e.g., high density polyethylene and polypropylene, polyamides, silicone resins, vinyl resins, and the like) and composite materials are preferred, even though many structural materials might also be suitable. It is desirable that the materials in the construction minimize moisture retention in the hanger system. Even strong materials such as balsa wood would therefore be less desirable because of its moisture absorbance. Highly polished and finished woods would be acceptable with regard to that moisture issue. The arms may be positioned or event adjustable to present angles between the arms and their respective support elements and/or the hanger system itself. The angle should be upward (above ninety degrees from the horizontal, but less than vertical, unless the arm was supported by an extension away from the vertical support rods. Angles of from 100 degrees to 170 degrees are a reasonable general range for the angle of the upward extending arms, The multiple boot hanging frame may be configured to swivel or be rigidly fixed in a position while being retained within the hanging engaging element. The hanger may have the multiple boot hanging element with two, three or four or more major outward arms. The second vertical support rod may be engaged with and extend below the hanger engaging element, and a lower portion of the second vertical support rod may be engaged with a second hanger connecting element. A second multiple boot hanging frame may be engaged with the second hanger connecting element. The second multiple boot hanging frame my include at least a second two major outward arms extending away from the second vertical support rod. Each of the at least second two major arms may include a second two vertical arms and each of the second two vertical arms having a sole support element angled upwardly away from the second vertical support rod. The sole support elements are relatively upwardly oriented, for example, forming a ten degree to eighty degree angle with the vertical arms, or preferably a twenty to seventy degree angle away from the vertical support rod, or more preferably from thirty to sixty degrees away from the vertical support rod and the vertical arms. The sole support could be at zero degrees in elevation, but this is less desirable. The sole support may also be hinged to the vertical support rod so that the angle is adjustable, as from 0 (or fewer) degrees to vertical or less (e.g., 80 degrees). The sole (sole of the boots) support element may have a top toe support stem and a lower heel support stem. The second (as with the first or independently from the first) multiple boot hanging frame may be configured to swivel while being retained within the hanging engaging element. As with the first multiple boot hanging element, the second multiple boot hanging element may have at least two, three, four or more major outward arms. The second multiple boot hanging frame may be engaged with the second hanger connecting element, the second multiple boot hanging frame may have at least a second two major outward arms extending away from the second vertical support rod, each of the at least second two major arms comprises a second two vertical arms and each of the second two vertical arms comprise a sole support element angled upwardly away from the second vertical support rod and the sole support element comprises a top toe support stem and a lower heel support stem. The second multiple boot hanging frame may also be configured to swivel while being retained within the hanging engaging element.

Reference to the Figures will provide further understanding of the present technology.

FIG. 1 shows a front view of a two hanger arm support hanger system 100. The two hanger arm support hanger system 100 is shown with a top hook 120, a topmost support element 118 having an opening, a first vertical support rod 102, a second topmost support element 114 having a top and bottom ridge (forming an opening) that engages and secures a hanger connecting element into which a multiple boot hanging frame 104 is removably inserted or permanently attached (the permanent attachment may be made in the initial structure by having the two elements molded as a single unit, of the two separate units may be fused\, soldered or adhesively secured into a permanent configuration). Ends of the multiple boot hanging frame 104 extends into vertical arms 122 and 122*a* which in turn extend into the sole support element angle upwardly away from the first vertical support rod sole support elements 106 which angle upwardly away (shown with about 70 to 20 degree angles from the first vertical support rod 102 and the arms 122 and 122*a*. A second vertical support rod 102*a* is shown extending from below the second topmost support element 114 to the third support element 114*a* having upper 116*a* and lower sole support element angle upwardly away from the first vertical support rod 102. The second topmost support element 114 supports a second vertical support rod 102*a* which extends downward to another support element 114*a* which includes swiveling support elements 116*c* and 116*d* that supports a second multiple boot hanging frame 104*a* with vertical arms 122*b* and 122*c* with respective sole support elements 106*a*.

As noted on the sole support elements 106 there may be a distinct toe stop or toe support element 108 and a distinct heel stop or heel support element 112. These two stops 108, 112 may be relatively horizontal (to the ground and approximately parallel to the multiple boot hanging arm 104) and may be adjustable, flexible or may telescope to gently support the respective elements of the boot. The stops may be formed of less rigid materials or comprise a cover that is less likely to damage interior surfaces of the boot when it is slid over the sole support 106 and the sole of the boot rests on the top surface 110 thereon. The stops can be substantive enough in length and materials to enable effective support and protection within the boot. The stops, for example, may be from 0.5, 0.75, 1.0, 1.5, 1.75, 2.0 or more inches in length, and may be at least 0.25, 0.50, 0.75 and at least 1.0 inches in width. Rubber, soft fabric or other lower abrasive socks or covers may be provided over the stops or the entire support element. Lower abrasion producing coatings may also be applied over the supports and/or stops, such as silicone polymers, polyurethane polymers, elastomeric polymers, polyvinyl resins, poly (fluorinated hydrocarbon) polymers such as Teflon® polymer or Kevlar® polymers may be used.

Figure 2:
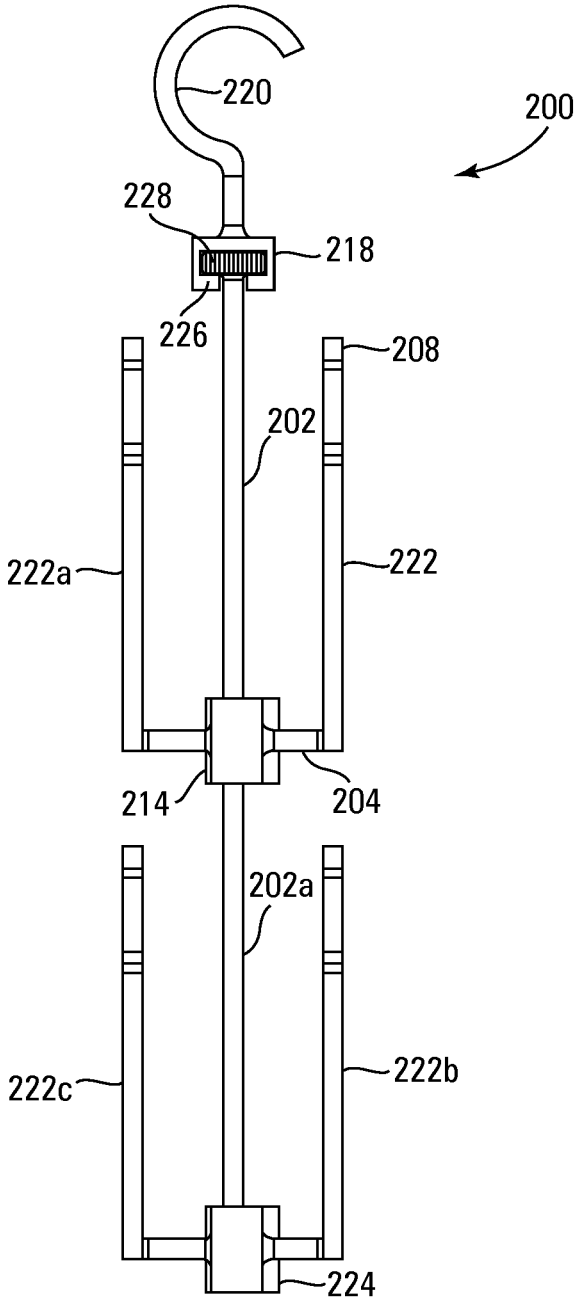
FIG. 2 is a perspective view of a boot hanger system according to the present technology.

FIG. 2 shows a perspective view of a two hanger arm support hanger system 200. The perspective view shows a hooking attachment element 220, the two, same axis vertical rods 202 and 202*a*, the hanging frame 204, the vertical arms 222 and 222*a*, the sole support element 208 (on arm 222), the top 218 and mid-214 and lower 224 support elements. Lower boot support vertical arms 222*b* and 222*c* are also shown. A rotating component 228 engaging the top support element 218 is also shown. The ability of the internal rotation of components allows for easier access to individual boots or boot pairs by changing the alignment of the various hanger elements and/or hanger segments.

Figure 3:
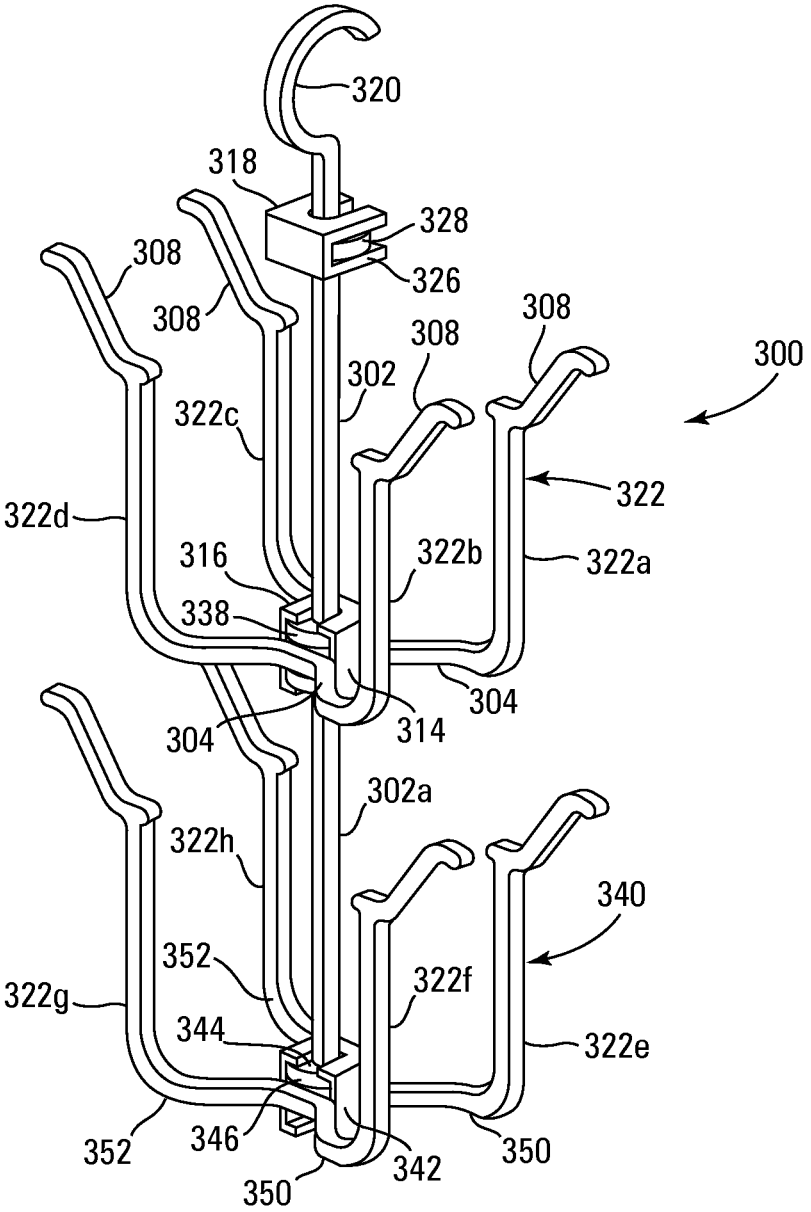
FIG. 3 is a perspective view of an eight hanger, dual level boot hanger system according to the present technology.

FIG. 3 shows a perspective view of a two hanger arm support hanger system 300 having four arms 322*a*, 322*b*, 322*c* and 322*d* on the top hanger 322, with the hooking attachment element 320, the two, same axis vertical rods 302 and 302*a*, the hanging four-arm frame 304, the vertical arms 322*a*, 322*b*, 322*c* and 322*d*, the sole support element 308 (on arm 322*a*), the top 318 and mid-314 and lower 342 support elements. A lower hanger element structure 340 with the second array of four arms and sole supports is also shown, along with a rigid lower support element 342. Both the top 318 and mid-316 support elements are shown with rotating (swiveling) engaging elements 328 and 318, respectively.

Further stacking or hanging of additional components such as shown by 340, with or without swiveling engaging elements as in 328 and 338 may be further present in the system.

It is to be noted that spacing between arms may be preferably different as shown in FIG. 3, where the spacing between arms 322*a* and 322*b* is smaller than between arms 322*b* and 322*c*, which may represent a distinction between pairs of boots, but more importantly reduces the width (e.g., between arms 322*a* and 322*b*) so that when the hangar systems (e.g., 300) are placed in a hanger, minimal width on a hanger pole (not shown) will be used. The dimensions between mid-points on the sole supports 308 on arms 322*a* and 322*b* should be between 6 inches to 12 inches, and the distances between mid-points in the sole supports 308 on arms 322*b* and 322*c* should be at least 30% greater. This differential can be accomplished or accentuated easily by the opposing curvatures illustrated on lower arms 322*e*, 322*f*, 322*g* and 322*h* with forward turning curvatures 350 directing respective sole supports 308 to be parallel with each other and the opposed direction of curvatures 352 making the attached respective sole supports 308 parallel with each other at the rear of the hangar system 300.

The stacking of the hanger elements on which the arms are supported (these are called hanger segments) can be done with as few as two hanger segments, and depending upon the height of the rod or hook or frame from which they depend, there may be three, four, five or even six hanger segments with at least two arms each, and preferably four or more arms on each hanger segment.

This design will also tend to reduce wear during storage as the sole support can be shaped (e.g., flattened, padded (with a sleeve), cushioned (with an adhesive applied cushioning insert) and supports only the weight of an individual boot. Although a few other boot support hangers have boots held sole up, their preferred overall design with the arms parallel for a pair of boots, the sole supports close to horizontal with the ground while the arms are close to perpendicular (to conserve space) makes the entire system a significant advance over other known constructions.

By having the boots support by the interior sole of the boot, stress is not put on visible exterior portions of the boot (e.g., boot strap holders, heel clip holders, wire exterior boot supports and the like) that can damage the observable exterior of the boot.

Other alternative materials and dimensions may be used by one skilled in the art and remain within the scope of the disclosed and enabled technology and the claimed invention. For example, the hanger system could have a pin or engaging element at its bottom that could be inserted into a wheeled base to make the system moveable along a floor, or a static stand that is relatively immobile.

What is claimed:

1. A transportable boot storage hanger designed for space-efficient and low-wear storage of multiple boots comprising:

a) a topmost support engaging element;

b) a first vertical support rod having a top end engaged with the topmost support engaging element and a lower portion of the first vertical support rod engaged with a hanger connecting element;

c) the hanger connecting element having a multiple boot hanging frame permanently attached thereto;

d) the multiple boot hanging frame having at least two major outward arms extending away from the opening;

e) each of the at least two major arms having a vertical arm and a sole support element angle upwardly away from the first vertical support rod; and f) the sole support element having a top toe support stem and a lower heel support stem.

2. The hanger of claim 1 wherein the multiple boot hanging frame is configured to swivel while being attached to the hanger connecting element.

3. The hanger of claim 1 wherein the multiple boot hanging frame element comprises at least three major outward arms.

4. The hanger of claim 1 wherein the multiple boot hanging frame element comprises four major outward arms.

5. The hanger of claim 4 wherein there are at least three multiple boot hanging frames elements secured vertically into a single transportable boot storage hanger.

6. The hanger of claim 1 wherein a second vertical support rod is engaged with and extends below the hanger connecting element, and a lower portion of the second vertical support rod is engaged with a second hanger connecting element.

7. The hanger of claim 6 wherein a second multiple boot hanging frame is engaged with the second hanger connecting element.

8. The hanger of claim 7 wherein the second multiple boot hanging frame comprises at least a second two major outward arms extending away from the second vertical support rod.

9. The hanger of claim 8 wherein each of the at least second two major arms comprises a second two vertical arms and each of the second two vertical arms comprise a sole support element angled upwardly away from the second vertical support rod.

10. The hanger of claim 9 wherein the sole support element comprises a top toe support stem and a lower heel support stem.

11. The hanger of claim 7 wherein the second multiple boot hanging frame is configured to swivel while being attached to the second hanger connecting element.

12. The hanger of claim 7 wherein the second multiple boot hanging frame element comprises at least three major outward arms.

13. The hanger of claim 7 wherein the second multiple boot hanging frame element comprises four major outward arms.

14. The hanger of claim 6 wherein a second multiple boot hanging frame is engaged with the second hanger connecting element, the second multiple boot hanging frame comprises at least a second two major outward arms extending away from the second vertical support rod, each of the at least second two major arms comprises a second two vertical arms and each of the second two vertical arms comprise a sole support element angled upwardly away from the second vertical support rod and the sole support element comprises a top toe support stem and a lower heel support stem.

15. The hanger of claim 14 wherein the second multiple boot hanging frame is configured to swivel while being attached to the second hanger connecting element.

16. The hanger of claim 15 wherein the second multiple boot hanging frame element comprises four major outward arms.

17. The hanger of claim 14 wherein the second multiple boot hanging frame element comprises at least three major outward arms.

18. The hanger of claim 14 wherein the second multiple boot hanging frame element comprises four major outward arms.

19. The hanger of claim 18 wherein there are at least three multiple boot hanging frames elements secured vertically into a single transportable boot storage hanger.

20. The hanger of claim 1 wherein there are at least three multiple boot hanging frames elements secured vertically into a single transportable boot storage hanger.

* * * * *